US005858637A

United States Patent [19]

Eshelman et al.

[11] Patent Number: 5,858,637

[45] Date of Patent: Jan. 12, 1999

[54] PROCESS OF PREPARING A PHOTOTHERMOGRAPHIC COMPOSITION OF ENHANCED PHOTOSENSITIVITY

[75] Inventors: Lyn M. Eshelman, Penfield; Mark E. Irving, Rochester; David H. Levy, Rochester; Kathleen R. C. Gisser, Rochester, all of N.Y.

[73] Assignee: Eastman Kodak Company, Rochester, N.Y.

[21] Appl. No.: 883,942

[22] Filed: Jun. 27, 1997

[51] Int. Cl.[6] ..... G03C 1/09; G03C 1/005; G03C 1/053

[52] U.S. Cl. ..... 430/569; 430/605; 430/619; 430/620; 430/603

[58] Field of Search ..... 430/605, 569, 430/619, 620, 603

[56] References Cited

U.S. PATENT DOCUMENTS

| | | | |
|---|---|---|---|
| 2,597,856 | 5/1952 | Damschroder | 430/603 |
| 2,597,915 | 5/1952 | Yutzy | 430/603 |
| 2,642,361 | 6/1953 | Damschroder et al. | 430/603 |
| 3,503,749 | 3/1970 | Travernier et al. | 430/603 |
| 3,700,458 | 10/1972 | Lindholm | 430/619 |
| 3,713,833 | 1/1973 | Lindholm et al. | 430/629 |
| 3,871,887 | 3/1975 | Jones | 430/619 |
| 3,887,597 | 6/1975 | Ohkubo et al. | 430/348 |
| 3,909,271 | 9/1975 | Ikenoue et al. | 430/570 |
| 4,207,108 | 6/1980 | Hiller | 430/354 |
| 4,435,499 | 3/1984 | Reeves | 430/350 |
| 4,478,927 | 10/1984 | Naito et al. | 430/203 |
| 4,621,041 | 11/1986 | Saikawa et al. | 430/204 |
| 4,639,414 | 1/1987 | Sakaguchi | 430/599 |
| 4,725,534 | 2/1988 | Kagami et al. | 430/619 |
| 4,751,176 | 6/1988 | Pham | 430/619 |
| 4,810,626 | 3/1989 | Burgmaier et al. | 430/569 |
| 5,001,042 | 3/1991 | Hasebe | 430/382 |
| 5,049,484 | 9/1991 | Deaton | 430/605 |
| 5,049,485 | 9/1991 | Deaton | 430/605 |
| 5,252,455 | 10/1993 | Deaton | 430/605 |
| 5,362,470 | 11/1994 | Masutomi et al. | 423/509 |
| 5,434,043 | 7/1995 | Zou et al. | 430/619 |
| 5,759,760 | 6/1998 | Lushington et al. | 430/603 |
| 5,759,761 | 6/1998 | Lushington et al. | 430/605 |

OTHER PUBLICATIONS

Research Disclosure, vol. 170, Jun. 1978, Item 17029.
Research Disclosure, vol. 389, Sep. 1996, Item 38957.

*Primary Examiner*—Mark F. Huff
*Attorney, Agent, or Firm*—Carl O. Thomas

[57] ABSTRACT

A process of preparing a photothermographic composition of enhanced photosensitivity is disclosed comprised of (a) precipitating light-sensitive silver halide grains in the presence of a non-aqueous polymeric peptizer and (b) then combining the silver halide grains with an oxidation-reduction image-forming combination comprised of an organic silver compound and a reducing agent for the silver organic compound. Light-sensitivity of the silver halide grains is enhanced by, prior to step (b), sensitizing the silver halide grains with a gold sensitizer dissolved in an aqueous medium.

8 Claims, No Drawings

PROCESS OF PREPARING A PHOTOTHERMOGRAPHIC COMPOSITION OF ENHANCED PHOTOSENSITIVITY

FIELD OF THE INVENTION

The invention relates to a process of enhancing the photosensitivity of a photothermographic composition containing silver halide grains.

DEFINITION OF TERMS

In referring to silver halide grains and emulsions containing two or more halides, the halides are named in order of ascending concentrations.

The term "photothermographic" in referring to compositions and elements indicates those that form an image when imagewise exposed to light and then uniformly heated.

The term "photographic" in referring to compositions and elements indicates those that form an image when imagewise exposed to light and brought into contact with an aqueous developer.

The term "grain size" is used to indicate mean grain equivalent circular diameter (ECD), where ECD is the diameter of a circle having an area equal to the grain projected area.

The term "peptizer" is used to indicate a material that physically interacts with silver halide grain surfaces to reduce grain clumping or settling from suspension in a liquid medium.

The term "vehicle" is used to indicate the material forming the continuous phase of a composition or layer containing silver halide grains. In a dried coating the vehicle is principally comprised of binder, peptizer and dispersed addenda, whereas prior to coating the vehicle additionally includes the liquids that are removed in drying.

The term "aqueous medium" is used to indicate water or an aqueous solution, optionally additionally containing other, water miscible solvents.

The term "non-aqueous" in referring to peptizers and vehicles refers to media that are immiscible with water.

*Research Disclosure* is published by Kenneth Mason Publications, Ltd., Dudley House, 12 North St., Emsworth, Hampshire P010 7DQ, England.

BACKGROUND

In its most common form silver halide photography employs silver halide grains that are precipitated in the presence of an aqueous gelatino-peptizer. After precipitation the grains are chemically sensitized and, if desired, spectrally sensitized. The emulsion is coated on a support to form a photographic element. Following imagewise exposure the photographic element is brought into contact with one or more aqueous processing solutions. During aqueous processing a developing agent is relied on to reduce silver halide to silver imagewise as a function of light exposure and, in color photography, to create a dye image.

Silver halide photographic elements and their chemical sensitization are summarized in *Research Disclosure,* Vol. 389, September 1996, Item 38957. Common chemical sensitizations are summarized in Section IV. Chemical sensitizers are generally assigned to three broad categories: (1) noble metal sensitizers, including gold and Group VIII metals, (2) middle chalcogen sensitizers, including sulfur, selenium and tellurium sensitizers, and (3) reduction sensitizers.

The following are specific examples of gold sensitizers: Tetrachloroaurate salts, disclosed by Damschroder U.S. Pat. No. 2,597,856 and Hasebe U.S. Pat. No. 5,001,042; dithiocyanatoaurate salts, disclosed by Saikawa et al U.S. Pat. No. 4,621,041; gold sulfide, disclosed by Yutzy et al U.S. Pat. No. 2,597,915, Yutzy et al U.S. Pat. No. 2,642,361, and Masutomi et al U.S. Pat. No. 5,362,470; gold thiolates, disclosed by Travernier et al U.S. Pat. No. 3,503,749; gold compounds that satisfy the formula:

$$AuL_2^+X^- \text{ or } AuL(L')^+L^-$$

wherein

L is a mesoionic ligand;

L' is a Lewis basic donor ligand; and

X is an anion, disclosed by Deaton U.S. Pat. Nos. 5,049,485 and 5,252,455; and gold compounds satisfying the formula:

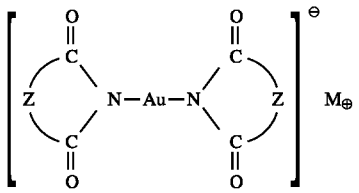

wherein

Z represents the atoms to complete a 5 or 6 membered heterocyclic ring and

M represents a charge balancing cation, disclosed by Deaton U.S. Pat. No. 5,049,484.

The advantage of photographic imaging as described above is that the highest attainable levels of photosensitivity are realized. A significant disadvantage is the requirement of bringing the photographic elements into contact with an aqueous processing solution during development—i.e., "wet" processing.

A way of avoiding wet processing is to employ a photosensitive element that can create a viewable "dry" image simply by being heated following imagewise exposure. *Research Disclosure*, Vol 170, June 1978, Item 17029, provides a summary of the many varied common photothermographic imaging systems. These photothermographic imaging systems have been broadly divided into Systems A and B.

In System A the photothermographic composition is comprised of photosensitive silver halide grains that are relied upon as the sole source of silver. System A has the advantage of being able to employ aqueous silver halide emulsions of the type employed in silver halide photographic systems, with their superior photosensitivity.

Photothermographic imaging systems predominantly fall into the System B category. The minimum essential components of System B are the following:

(a) photosensitive silver halide grains, (b) an oxidation-reduction image-forming combination comprised of (i) an organic silver compound and (ii) an organic reducing agent and (c) a vehicle.

The organic silver compounds that are most efficiently catalyzed by light-exposed silver halide grains to enter into an oxidation-reduction reaction in response to heating are those that are most conveniently dispersed in non-aqueous polymeric vehicles. Thus, although techniques are known for combining aqueous silver halide emulsions with the oxidation-reduction combination, the disadvantages of combining silver halide grains precipitated in an aqueous peptizer with a non-aqueous polymeric vehicle containing the oxidation-reduction combination more than offset any advantage of this approach. Therefore, it is generally preferred and most convenient to form the silver halide grains of component (a) in the presence of a non-aqueous polymeric peptizer.

Silver halide grains are formed in the presence of non-aqueous polymeric peptizer using either in situ or ex situ techniques. The in situ technique converts a portion of the organic silver compound (i) of the oxidation-reduction combination (b) to silver halide. The disadvantage of this technique is that chemical sensitization of the silver halide to increase photosensitivity is difficult. Typically chemical sensitization involves (1) adding a chemical sensitizing compound and (2) holding the silver halide at an elevated temperature for a period sufficient to allow interaction of the silver halide and the sensitizer. Since the in situ formation of the silver halide requires the presence of the organic silver compound, which is necessarily heat sensitive, it is apparent that heating runs the risk of unwanted silver ion release, thereby degrading image quality.

This disadvantage is avoided by undertaking ex situ silver halide grain formation, wherein, by definition, the organic silver compound is not present while the silver halide grains are being prepared. In addition, silver halide grain formation in the absence of the organic silver compound is generally simpler and more convenient than in situ grain formation.

In most instances photothermographic compositions are prepared and used without employing any chemical sensitization step comparable to that employed in preparing silver halide photographic emulsions. This is because silver halide photothermographic compositions are generally much slower than silver halide photographic compositions and have been commonly relegated to imaging applications that are compatible with low imaging speeds.

*Research Disclosure*i Item 17029, cited above, Section VI. Chemical Sensitization/Speed Addenda discloses a variety of sensitizations that have been developed for chemically sensitizing silver halide emulsions containing non-aqueous polymeric peptizers and silver halide formed in the non-aqueous polymeric vehicles of System B.

The following patents particularly directed to photothermography have been considered:

I. System A photothermographic systems, aqueous silver halide precipitations and vehicle:
Sakaguchi U.S. Pat. No. 4,639,414.

II. System B photothermographic systems, aqueous silver halide precipitations:
Lindholm et al U.S. Pat. No. 3,700,458;
Ikenoue et al U.S. Pat. No. 3,909,271;
Reeves et al U.S. Pat. No. 4,435,499; and
Zou et al U.S. Pat. No. 5,434,043.

III. System B photothermographic systems, in situ silver halide precipitation:
Ohkubo et al U.S. Pat. No. 3,887,597 and
Naito et al U.S. Pat. No. 4,478,927.

IV. System B photothermographic systems, ex situ silver halide precipitation in non-aqueous polymeric peptizer:
Lindholm et al U.S. Pat. No. 3,713,833;
Jones U.S. Pat. No. 3,871,887;
Hiller U.S. Pat. No. 4,207,108;
Kagami et al U.S. Pat. No. 4,725,534; and
Pham U.S. Pat. No. 4,751,176.

Lushington and Gysling U.S. Pat. No. 5,759,761, filed Jun. 4, 1997, titled GOLD CHEMICAL SENSITIZERS FOR SILVER HALIDES, commonly assigned, is directed to silver halide grains sensitized with at least one gold compound of the formula:

$$\{AuS_2X\}_n$$

wherein

X is $PR_2$, $P(OR)_2$, COR, $CNR_2$ or CR;

R is alkyl or aryl; and n is an integer of from 1 to 6.

SUMMARY OF THE INVENTION

In one aspect this invention is directed to a process of preparing a photothermographic composition of enhanced photosensitivity comprised of (a) precipitating light-sensitive silver halide grains in the presence of a non-aqueous polymeric peptizer and (b) then combining the silver halide grains with a non-aqueous polymeric vehicle containing an oxidation-reduction image-forming combination comprised of an organic silver compound and a reducing agent for the organic silver compound, wherein light-sensitivity of the silver halide grains is enhanced by, prior to step (b), sensitizing the silver halide grains with a gold sensitizer dissolved in an aqueous medium.

It has been discovered quite unexpectedly that superior levels of photosensitivity are realized when gold sensitizer is dissolved in an aqueous medium and then brought into contact with silver halide grains formed ex situ in a non-aqueous polymeric peptizer. Whereas it would seem logical that the same types of organic dispersing media employed in combination with non-aqueous polymeric peptizers and vehicles would provide a more intimate association of the silver halide grains and gold sensitizers and therefore lead to superior levels of photosensitivity, this intuitively obvious observation has, in fact, been found to be in error. Instead, dissolving the gold sensitizers in water is shown in the Examples below to provide superior photosensitivity.

DESCRIPTION OF PREFERRED EMBODIMENTS

The present invention is directed to a process of preparing a photothermographic composition that exhibits enhanced photosensitivity. This is achieved by the ex situ precipitation of silver halide grains in a non-aqueous polymeric peptizer, followed by chemical sensitization with a gold chemical sensitizer dissolved in an aqueous medium. The gold sensitized silver halide emulsion is then blended with an oxidation-reduction image-forming combination comprised of an organic silver compound and a reducing agent for the organic silver compound. Further enhancements in photosensitivity can be realized by specific selections of gold chemical sensitizers and by combining gold sensitization with sulfur sensitization. The photothermographic compositions produced by the process of the invention are compatible with other conventional components of photothermographic elements containing ex situ silver halide grains formed in the presence of a non-aqueous polymeric peptizer.

The ex situ precipitation of silver halide grains in the presence of a non-aqueous polymeric peptizer can be undertaken by any convenient conventional technique. Such precipitations can be conducted, for example, according to the teachings of Lindholm et al U.S. Pat. No. 3,713,833, Jones U.S. Pat. No. 3,871,887, Hiller U.S. Pat. No. 4,207,108, Kagami et al U.S. Pat. No. 4,725,534, and Pham U.S. Pat. No. 4,751,176, cited above and here incorporated by reference. Still another teaching is provided by *Research Disclosure*, Vol. 125, Sept. 1974, Item 12537.

A large variety of non-aqueous polymeric peptizers are known to be useful for the ex situ precipitation of the silver halide grains. These peptizers, variously referred to in the art as organic resins, synthetic polymers and hydrophobic polymers include those derived from monomers of amides or esters of ethylenically unsaturated acids, including maleic acids, acrylic acids and methacrylic acids. Monomers of this type with pendant thiaalkyl pendant groups are disclosed by Lindholm et al U.S. Pat. No. 3,713,833. Jones U.S. Pat. No. 3,871,887 additionally discloses to be useful as peptizers vinylpyridine polymers, such as those derived from 2-vinylpyridine, 4-vinylpyridine and 2-methyl-5-vinylpyridine monomers.

Preferred non-aqueous polymeric peptizers are poly(vinyl acetals), such as poly(vinyl acetal) and poly(vinyl butyral). Specifically preferred poly(vinyl acetals) are copolymers synthesized in the presence of minor amounts of other monomers that optimize physical properties. For example, Butvar™, available from Monsanto, includes types B-72, B-73, B-74, B-76, B-79, B-90 and B-98, each of which can be employed as peptizers in the practice of this invention, include from 80 to 88 mole percent vinyl butyral derived repeating units, from 0 to 2.5 mole percent vinyl alcohol derived repeating units, and 10 to 20 mole percent vinyl acetate derived repeating units. Selections of poly(vinyl acetal) copolymers for optimum physical properties are disclosed in Hazalik et al U.S. Pat. Nos. 5,340,613, 5,378,542 and 5,415,993, the disclosures of which are here incorporated by reference.

The non-aqueous polymeric peptizers are dispersed in a volatile organic solvent. Preferably the polymeric peptizers are within a molecular weight range of from 10,000 to 500,000, most preferably from 30,000 to 250,000. The volatile organic solvent is chosen to be removable from the composition by heating to a temperature of less than 165° C., preferably less than 90° C. Only small levels of peptizer are required to hold silver halide grains in suspension. Peptizer concentrations prior to silver halide grain formation can range as low as 0.1 percent by weight, based on the weight of the volatile organic solvent. Seldom are peptizer concentrations above 20 percent by weight, based on the weight of the solvent, required. A preferred range of peptizer concentrations is from about 1 to 10 percent by weight, based on organic solvent weight A wide range of volatile organic solvents are known and available for use. Typically the solvents are chosen from among alcohols, ketones, esters, ethers, aliphatic hydrocarbons, aromatic hydrocarbons, and amides, either employed alone or in combination. The alcohols include both glycols and glycerols. A listing of typical useful volatile organic solvents is contained in Kagami et al U.S. Pat. No. 4,725,534, cited above, the disclosure of which is here incorporated by reference.

The ex situ precipitation of silver halide grains is accomplished by introducing a silver salt, such as silver nitrate, silver trifluoroacetate or silver perchlorate, and one or a combination of halide salts, such as an ammonium or alkali halide, into the volatile organic solvent containing the non-aqueous polymeric peptizer. The silver halide grains formed include silver chloride, silver bromide, silver bromochloride, silver chlorobromide, silver iodochloride, silver iodobromide, silver iodobromocloride, silver iodochlorobromide, silver bromoiodochloride and silver chloroiodobromide. Preferably iodide is limited to less than 10 mole percent, optimally less than 5 mole percent, based on total silver forming the silver halide grains.

Precipitation is continued until the grains reach a size that satisfies the requirements of the imaging application contemplated. As is generally well understood in the art, the photosensitivity of silver halide grains increases as grain size increases. Unfortunately, image noise (granularity) also increases with increasing grain size. Thus, grain sizes are generally chosen to arrive at an optimum balance between photosensitivity and image noise. For microfilm, which particularly benefits from minimal image noise, grain sizes can range down to Lippmann levels—e.g., down to about 0.05 $\mu$m. At the other extreme, for higher speed imaging grain sizes of up to 5 $\mu$m are contemplated to maximize image speed. Reeves U.S. Pat. No. 4,435,499, cited above and here incorporated by reference, discloses tabular grains extending to even larger grain sizes to be useful in photothermographic imaging.

Following precipitation of the silver halide grains, they are chemically sensitized by addition of one or more chemical sensitizers, including at least one gold sensitizer, and holding at an elevated temperature. The gold sensitizer is dissolved in an aqueous medium. Any conventional gold sensitizer that can be dissolved in an aqueous medium can be employed in the practice of this invention. Thus, the gold sensitizers that are conventionally employed in aqueous gelatino-silver halide emulsions, such as those disclosed in *Research Disclosure*, Item 38957, Section IV, cited above, are generally useful in the practice of this invention.

When the aqueous medium containing the gold sensitizer partitions as a separate phase (i.e., is immiscible with) the volatile organic solvents employed with the non-aqueous polymeric peptizer for the silver halide grains, as is usually the case, vigorous stirring is required to bring the gold sensitizer into proximity with the silver halide grains. Agitation is required throughout the interval during which gold sensitization is occurring. Conventional vigorous stirring mechanisms of the type employed during silver halide precipitation are contemplated for use during chemical sensitization.

Although some gold sensitizers are effective at room temperature or temperatures only slightly above room temperature, typically chemical sensitization is undertaken in the temperature range of from 30° to 90° C., preferably 40° to 70° C. Optimum sensitizations are conventionally achieved by subjecting small alloquats of the emulsion to different time and temperature profiles. The highest attainable speed that is compatible with minimum density requirements is taken as the optimum sensitization. In comparing the speeds of emulsions sensitized by different techniques, the emulsions are finished to at least approximately the same minimum density.

Any conventional water soluble gold sensitizer can be employed. Generally gold in the sensitizer is present in its +1 or +3 oxidation state. Some gold sensitizers additionally contain sulfur and are capable of concurrently providing both sulfur and gold sensitization. In some gold sensitizers sulfur is also present, but not in a labile form that is available for sulfur sensitization. When a gold sensitizer is incapable of concurrently providing sulfur sensitization, it can, of course, be used alone. Alternatively, the gold sensitizer can be employed in combination with a conventional sulfur sensitizer that is also capable of being dispersed in an aqueous medium. Further, it is appreciated that both selenium and tellurium analogues of the useful sulfur sensitizers are known to be effective sensitizers and can be used in place of sulfur or in addition to sulfur sensitizers. Finally, mixtures of the water soluble gold compounds can be used in the aqueous media. In other words, in addition to gold sensitization all chemical sensitizers that are known to be useful in aqueous media and capable of being used in combination with gold sensitizers in aqueous media can be employed.

Thus, gold sensitizers, employed alone, or in combination with other sensitizers in aqueous media of the type disclosed in *Research Disclosure*, Item 38957, Section IV, are specifically contemplated. All chemical sensitizations are preferably concurrently undertaken in a single heating step. Sensitizations developed for silver halide grains suspended by organic solvents and non-aqueous polymeric peptizers are most conveniently elided from the practice of this invention.

Illustrations of gold sensitizers specifically contemplated for use in the practice of the invention include the following:

I. Tetrachloroaurate salts, such as those satisfying the formula $M\{AuCl_4\}$ (M=H, Na, K). Gold sensitizers of this type are disclosed by Damschroder U.S. Pat. No. 2,597,856 and Hasebe U.S. Pat. No. 5,001,042, the disclosures of which are here incorporated by reference.

II. Dithiocyanatoaurate salts, such as those satisfying the formula $M\{Au(SCN)_2\}$ (M=K, $NH_4$). Gold sensitizers of this type are disclosed by Saikawa et al U.S. Pat. No. 4,621,041 and Hasebe, U.S. Pat. No. 5,001,042, the disclosures of which are here incorporated by reference.

III. Gold dithiosulfate salts, such as those satisfying the formula $Na_3\{Au(S_2O_3)_2\}.2H_2O$. Gold sensitizers of this type are disclosed by P. Faelens, R. Berendser, and B. H. Tavernier, Phot Korr., 53, 75 (1966).

IV. Gold sulfide ($Au_2S$), disclosed by Yutzy et al U.S. Pat. No. 2,597,915, Damschroder et al U.S. Pat. No. 2,642,361, and Masutomi et al U.S. Pat. No. 5,362,470, the disclosures of which are here incorporated by reference.

V. Gold thiolates, such as those satisfying the formula AuS—X—$SO_3$M, wherein X is an aliphatic aromatic or heterocyclic bivalent radical, and M is H, an alkali or alkaline earth metal, or $NH_4$. Gold sensitizers of this type are disclosed by Travernier et al U.S. Pat. No. 3,503,749.

VI. Gold compounds of the formula $\{AuL_2\}^+X^-$ or $\{AuLL'\}^+X^-$ wherein L is a mesoionic ligand, L' is a Lewis base donor ligand, and X is an anion (e.g.,$BF_4^-$). The mesionic ligand is typically a cyclic or acyclic thiourea. Gold sensitizers of this type are disclosed by Deaton U.S. Pat. Nos. 5,049,485 and 5,220,030, the disclosure of which is here incorporated by reference. Gold compounds of this type are particularly preferred, since higher levels of photosensitivity have been realized by employing these compounds in the practice of the invention than when employing other types of gold compounds as sensitizers.

The following are specifically contemplated embodiments:

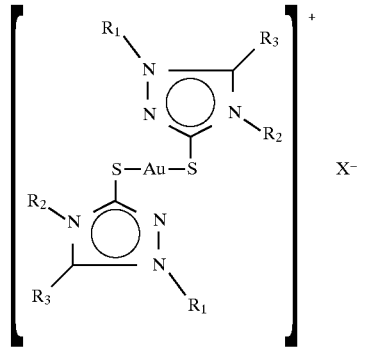

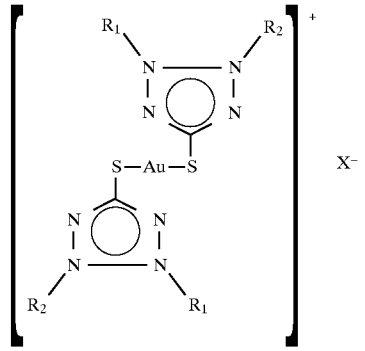

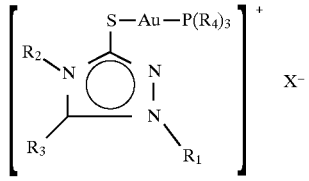

and

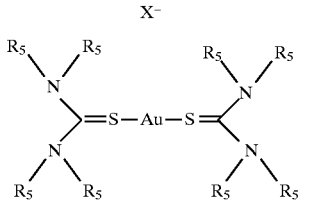

wherein $R_1$, $R_2$, $R_3$, $R_4$ and $R_5$ are hydrogen or hydrocarbon groups and X is a charge balancing anion.

Preferably, $R_1$ and $R_4$ are independently chosen lower alkyl (e.g., methyl);

$R_2$, $R_3$ and $R_5$ are independently chosen from among lower alkyl (e.g., methyl), alkoxyalkyl (e.g., β-methoxyethyl), allyl, aryl (e.g., phenyl), or cycloalkyl (e.g., cyclohexyl); and $X^-$ is an anion chosen from among $BF_4^-$, $I^-$, $Br^-$ and $Cl^-$.

A particularly preferred species is bis(1,4,5-trimethyl-1,2,4-triazolium-3-thiolate)-gold(I) tetrafluoroborate (TTT AuT) which has the structural formula:

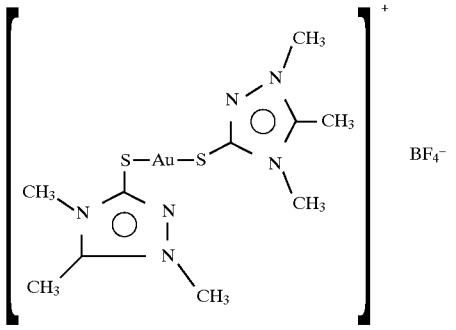

V. Gold compounds of the formula:

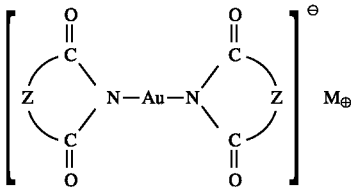

wherein M is a charge balancing cation and Z is chosen to complete a 5 or 6 membered ring forming an imide nucleus. Gold sensitizers of this type are disclosed by Deaton U.S. Pat. No. 5,049,484, the disclosure of which is here incorporated by reference.

VI. A gold compound containing at least one gold atom linking at least two divalent sulfur or selenium chalcogen atoms in a cyclic thioether or selenoether containing from 12 to 30 ring atoms. Typically these gold compounds satisfy the formula $\{AuL\}^+X^-$ or $\{AuL\}_2{}^+2X^-$, where L is a macrocyclic compound containing at least two thioether and/or selenoether groups within a ring which comprises 12–30 atoms, and X is an anion (e.g., $BF_4^-$). The ligands L can satisfy the formula:

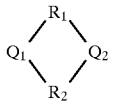

wherein $Q_1$ and $Q_2$ are each independently sulfur or selenium and $R_1$ and $R_2$ are alkylene groups containing from 5 to 14 carbon atoms that can be in part replaced by heteroatoms, such as oxygen, sulfur, selenium or nitrogen that form functional groups, such as carboxylic esters or carboxylic amide linkages. The gold atoms bridge $Q_1$ and $Q_2$. Gold sensitizers of this type are disclosed by Deaton U.S. Pat. Nos. 5,252,455 and 5,391,727, the disclosures of which are here incorporated by reference.

VII. Gold compounds having the formula:

$$\{AuS_2X\}_n$$

wherein X is a dithiophosphinate, a dithiophosphate, a xanthate, a dithiocarbamate, or a dithiocarboxylate, and n is an integer of from 1 to 6. Such gold sensitizers are disclosed in Lushington et al, cited above and here incorporated by reference.

The type III and IV gold compounds above also act as sulfur sensitizers.

In addition to chemical sensitization the silver halide grains can, if desired, be spectrally sensitized. Spectral sensitization and spectral sensitizing dyes are disclosed in *Research Disclosure*, Item 38957, cited above, Section V.A. Spectral sensitizing dyes. Particularly useful in emulsions containing non-aqueous polymeric peptizers, as herein contemplated, are the selections of spectral sensitizing dyes disclosed by *Research Disclosure*, Item 17029, cited above, IX. Spectral Sensitization, System B.

The sensitized silver halide grains and the medium in which they are suspended, including non-aqueous polymeric peptizer and organic solvent, are then added to a non-aqueous polymeric vehicle containing an oxidation-reduction image-forming combination comprised of an organic silver compound and a reducing agent for the organic silver compound.

A summary of useful organic silver compounds is provided in *Research Disclosure*, Item 17029, cited above, Section II. Metallic Salt or Complex of an Organic Compound as An Oxidizing Agent Unlike the sensitized silver halide grains, the organic silver compound is not relied upon for light-sensitivity. The organic silver compound is comparatively stable to light, but forms a silver image when heated to 80° C. or higher in the presence of an exposed photocatalyst (such as silver halide) and a reducing agent.

Suitable organic silver compounds include silver salts of organic compounds having a carboxyl group. Preferred examples thereof include silver salts of aliphatic and aromatic carboxylic acids. Preferred examples of the silver compounds of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver compounds which are substitutable with a halogen atom or a hydroxyl group can also be effectively used. Preferred examples of the silver compounds of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in Sullivan et al U.S. Pat. No. 3,785,830, and silver compounds of an aliphatic carboxylic acid containing a thioether group as described in Weyde et al U.S. Pat. No. 3,330,663.

Silver compounds containing mercapto or thione groups and derivatives thereof can be used. Preferred examples of these compounds include a silver compound of 3-mercapto-4-phenyl-1,2,4-triazole, a silver compound of 2-mercaptobenzimidazole, a silver compound of 2-mercapto-5-aminothiadiazole, a silver compound of 2-(2-ethyl-glycolamido)benzothiazole, a silver compound of thioglycolic acid such as a silver compound of a S-alkylthioglycolic acid (wherein the alkyl group has from 12 to 22 carbon atoms) as described in Japanese patent publication No. 28221/73, a silver compound of a dithiocarboxylic acid such as a silver compound of dithioacetic acid, a silver compound of thioamide, a silver compound of 5-carboxylic-1-methyl-2-phenyl-4-thiopyridine, a silver compound of mercaptotriazine, a silver compound of 2-mercaptobenzoxazole, a silver compound as describe in Knight et al U.S. Pat. No. 4,123,274, for example a silver compound of 1,2,4-mercaptothiazole derivative such as a silver compound of 3-amino-5-benzylthio-1,2,4-thiazole, a silver compound of a thione compound such as a silver compound of 3-(2-carboxyethyl)-4-methyl-4-thiazoline-2-thione as disclosed in Humphlett et al U.S. Pat. No. 3,301,678.

Furthermore, a silver compound of a compound containing an imino group can be used. Preferred examples of these compounds include a silver compound of benzothiazole and a derivative thereof as described in Japanese patent publications Nos. 30270/69 and 18146/70, for example, a silver compound of benzothiazole such as silver compound of methylbenzotriazole, etc., a silver compound of a halogen substituted benzotriazole, such as a silver compound of 5-chlorobenzotriazole, etc., a silver compound of 1,2,4-triazole, of 1H-tetrazole as described in deMauriac U.S. Pat. No. 4,220,709, a silver compound of imidazole and an imidazole derivative, and the like.

It is also found convenient to use silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used. The method used for making silver soap dispersions is well known in the art and is disclosed in *Research Disclosure*, Vol 234, Oct. 1983, Item 23419, and Gabrielson et al U.S. Pat. No. 3,985,565.

The reducing agent for the organic silver salt may be any material, preferably an organic material, that can reduce silver ion to metallic silver. Conventional photographic developers such as 3-pyrazolidinones, hydroquinones, and catechol are useful, but hindered phenol reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenylhydrazine, hydroxamic acids such as phenylhydroxamic acid, p-hydroxyphenylhydroxamic acid, and o-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl α-cyano-2-methylphenylacetate, ethyl α-cyano-phenylacetate; bis-o-naphthols as illustrated by 2,2'-dihydroxyl-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfon-amido-phenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bis-phenols, e.g., bis(2-hydroxy-3-t-butyl-5-methylphenyl)methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl)propane; ascorbic acid derivatives, e.g., 1-ascorbyl-palmitate, ascorbylstearate and unsaturated aldehydes and ketones, such as benzyl and diacetyl; 3-pyrazolidones; and certain indane-1,3-diones.

In addition to the organic silver compound and the reducing the agent the vehicle typically additionally includes a binder dispersed in a volatile organic solvent. The same non-aqueous polymers and volatile organic solvents described above in connection with the light-sensitive silver halide grain emulsions can be employed and are preferred. Thus, after the combining step (b) of the process of the invention is performed, the peptizer and binder components of the vehicle become indistinguishable. It is, of course, appreciated that a still broader range of polymers are useful as binders, since the binders are employed primarily for optimizing the physical properties of photothermographic layers rather than silver halide grain suspension. Thus, hydrophobic polymers that can be homogeneously distributed within the photothermographic composition as well as latices are contemplated. Common latex forming polymers employed as binder extenders are disclosed in *Research Disclosure*, Item 38957, II.C. Other vehicle components.

The light-sensitive silver halide grains are preferably coated to form from 0.01 to 15 percent by weight of a photothermographic layer, although higher amounts of up to 20 or even 25 percent of the emulsion layer weight are useful. It is most preferred to coat the silver halide to account for from 1 to 10 (optimally 1.5 to 7) percent of the total weight a photothermographic layer. The silver compound forming the oxidizing agent of the oxidation-reduction combination typically accounts for from 20 to 70 (preferably 30 to 55) percent of the total weight of a photothermographic layer. The reducing agent of the oxidation-reduction combination typically accounts for from 1 to 15 (preferably 2 to 10) percent, based on the total weight of a photothermographic layer. The remainder of each photothermographic layer can be accounted for by the peptizer and binder forming the vehicle as well as conventional performance enhancing addenda, where employed. The volatile organic solvents can be present in photothermographic compositions in any proportions providing composition viscosities convenient for blending and coating, since the organic solvents are removed by evaporation after coating.

In forming viewable silver images, tone modifiers, such as those illustrated by *Research Disclosure*, Item 17029, cited above, V. Tone Modifiers, are particularly important to modifying silver particle formation during development and hence providing a more uniform and pleasing image tone. Examples of toners include phthalimide and N-hydroxyphthalimide; cyclic imides such as succinimide, pyrazoline-5-ones and a quinazolinone 1-phenylurazole, 3-phenyl-2-pyrazoline-5-one, quinazoline and 2,4-thiazolidinedione; naphthalimides such as N-hydroxy-1,8-naphthalimide; cobalt complexes such as cobaltic hexamine trifluoroacetate; mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aninomethyl)aryldicarboximides, e.g., (N-dimethylaminomethyl)-phthalimide, and N-(dimethylaminomethyl)naphthalene-2,3-dicarboximide; and a combination of blocked pyrazoles, isothiuronium derivatives and certain photobleach agents, e.g., a combination of N,N'-hexamethylene-bis(1-carbamoyl-3,5-dimethylpyrazole), 1,8-(3,6-diazaoctane)bis(isothiuronium) trifluoroacetate and 2-(tribromomethylsulfonyl benzothiazole); and merocyanine dyes such as 3-ethyl-5[(3-ethyl-2-benzothiazolinylidene)-1-methyl-ethylidene]-2-thio-2,4-o-azolidinedione; phthalazine and phthalazine derivatives; 1-(2H)-phthalazinone and 1-(2H)-phthalazinone derivatives or metal salts of these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus phthalic acid derivatives, e.g., phthalic acid, 4-methylphthalic acid, 4-nitrophthalic acid, and tetrachlorophthalic anhydride; quinazolinediones, benzoxazine or naphthoxazine derivatives; rhodium complexes such as ammonium hexachlororhodate (III), rhodium bromide, rhodium nitrate and potassium hexachlororhodate (III); inorganic peroxides and persulfates, e.g., ammonium peroxydisulfate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asym-triazines, e.g., 2,4-dihydroxypyrimides, 2-hydroxy-4-aminopyrimidine, and azauracil, and tetrazapentalene derivatives, e.g., 3,6-dimercapto-1,4-diphenyl-1H,4H-2,3a,5,6a-tetrazapentalene, and 1,4-di(o-chlorophenyl)-3,6-dimercapto-1H,4H-2,3a,5,6a-tetrazapentalene.

The preferred concentrations of toners are in the range of from 0.01 (most preferably 0.1) to 10 percent by weight, based on the total weight of the photothermographic layer.

Antifoggants and stabilizers for the photosensitive silver halide grains are preferably incorporated in the photothermographic layer. A variety of base generating materials, commonly referred to as activators, are conventionally employed in photothermographic layers to improve development. In order to simplify the coating compositions, activation and stabilization can be combined. Addenda in these classes are illustrated by *Research Disclosure*, Item 17029, cited above, IV. Activators/Activator-Stabilizers/Stabilizers, A. Activators and Activator Precursors, B. Stabilizers and Stabilizer Precursors, and C. Activator/Stabilizers and Activator/Stabilizer Precursors, and VIII. Antifoggants/Post-processing Print-Out Stabilizers.

Specifically preferred antifoggants and stabilizers which can be used alone or in combination, include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et al., British Patent No. 623,448; the polyvalent metal salts described in Jones, U.S. Pat. No. 2,839,405; the thiuronium salts described by Herz, U.S. Pat. No. 3,220,839; and palladium, platinum and gold salts described in Trivelli, U.S. Pat. No. 2,566,263 and Damschroder, U.S. Pat. No. 2,597,915.

Other conventional addenda and photothermographic element features specifically contemplated include the following, illustrated by *Research Disclosure,* Item 17029, cited above:

VII. Development Modifiers
System B.
X. Coating Aids
XI. Overcoat Layers
XII. Interlayer/Barrier Layers
XIV. Filter Dyes/Antihalation Layers
XV. Color Materials
XVII. Supports
A. Paper Supports
B. Film Supports

EXAMPLES

The invention can be better appreciated by reference to the following specific embodiments of the invention:

Emulsion E1

Silver halide emulsion E-1 was precipitated by mixing lithium bromide, silver trifluoroacetate, and poly(vinyl butyral) in acetone under controlled conditions to yield grains having a mean size of 0.07 $\mu$m.

This procedure is known in the art as ex situ silver halide preparation and has been described, for example, in Jones U.S. Pat. No. 3,871,887 at column 9, line 58, through column 10, line 3.

Chemical Sensitizer Sources

Procedure A

Chemical sensitizing sources W1 through W5 were prepared in the following manner: Fifteen grams of an aqueous solution containing 75 mg of the chemical sensitizer identified in Table I were added to a vigorously agitated solution containing 37 grams of 5% by weight Butvar B76™ in toluene and 2.3 grams of benzyl alcohol. The Butvar B76, according to manufacturer published specifications, has an average molecular weight in the range of from 90 to 120 thousand, a hydroxyl content expressed as mole percent poly(vinyl alcohol) of from 11.0 to 13.0 percent, an acetate content expressed as poly(vinyl acetate) of from 0 to 2.5 percent, and a poly(vinyl butyral) content of 80 percent.

The mixture was agitated with an ultrasonic probe driven at 60 watts for 6 minutes. This resulted in the chemical sensitizer in the amount of 0.13 percent by weight, based on total weight, being dispersed in the aqueous solvent. These sensitizers were miscible with the dispersing media of Emulsion E1.

Procedure B

Chemical sensitizers were also incorporated directly into acetone without first dissolving them in water to provide a series of chemical sensitizer sources NW1–NW5. Sodium aurous(I) dithiosulfate and sodium thiosulfate are insoluble in acetone and were dispersed by ball milling into an acetone solution containing 5% by weight Butvar B76. This procedure provided solid particle dispersions NW1 and NW2. Acetone solutions of potassium tetrachloroaurate, TTTAuT, and, bis(1,1,3,3-tetramethylthiourea) tetrafluoroborate (BTMTT), were prepared and were designated NW3, NW4, and NW5, respectively. Each material contained 0.13 percent by weight, based on total weight, chemical sensitizer and was miscible with the solvent environment of Emulsion E1.

TABLE I

| Chemical Sensitizing Dispersion | Chemical Sensitizer |
|---|---|
| W1 | sodium aurous (I) dithiosulfate |
| W2 | sodium thiosulfate |
| W3 | potassium tetrachloroaurate |
| W4 | TTTAuT |
| W5 | BTMTT |

TABLE I-continued

| Chemical Sensitizing Dispersion | Chemical Sensitizer |
|---|---|
| W6 | none (water dispersion) |
| NW1 | sodium aurous (I) dithiosulfate |
| NW2 | sodium thiosulfate |
| NW3 | potassium tetrachloroaurate |
| NW4 | TTTAuT |
| NW5 | BTMTT |

The effectiveness of the chemical sensitizer sources were assessed in the following manner: The chemical sensitizer source was added to a small portion of Emulsion E1 to provide the desired sensitizer level. The mixture was heated for ten minutes at 55° C. and cooled to room temperature. Each sensitized emulsion was coated onto a film support in a photothermographic layer which contained 43 mg/dm$^2$ of poly(vinyl butyral) binder, 2.26 mg/dm$^2$ of silver provided by the silver halide grains, and 11.5 mg/dm$^2$ of silver provided by silver behenate. The coatings also contained 14 mg/dm$^2$ of N-(4-hydroxyphenyl)benzenesulfonamide as a developing agent and 2.48 mg/dm$^2$ of succinimide as a development accelerator. The photothermographic coatings also contained 0.68 mg/dm$^2$ of 2-bromo-2-(4-methylphenylsulfonyl) acetamide, 0.16 mg/dm$^2$ of 2,4-bis (trichloromethyl)-6-(1-naphtho)-s-triazine, 0.06 mg/dm$^2$ of dimethyl siloxane, and 0.16 mg/dm$^2$ of palmitic acid. The coating vehicle was a solvent mixture containing methyl iso-butyl ketone, toluene and acetone.

Sensitometry

The coatings were exposed through a 0–4 neutral density step tablet for ⅕" with a 3000° K light source at 5.09 log lux, followed by thermal processing for six seconds at 120° C. Speed is reported in relative log units (30 units=0.30 log E, where E represents exposure in lux-seconds) and was measured at a density of 1.0 above minimum density.

Coatings A1, A2, and A3, compared in Table II, demonstrate that chemical sensitization of Emulsion E1 did not occur as a result of heating the emulsion, or heating the emulsion in the presence of water suspension W6. Silver halide Emulsion E1 in coating A1 was not chemically sensitized. A portion of Emulsion E1 was heated in the absence of chemical sensitizers to provide the light sensitive element of coating A2. Four grams of water dispersion W6 were added to eleven grams of Emulsion E1, and the mixture was heated to provide the light sensitive element of coating A3. Sensitometric results summarized in Table II demonstrate these procedures resulted in photothermographic coatings with higher fog and similar speed to coating A1.

TABLE II

| Coating | DMIN | Speed |
|---|---|---|
| A1 (comparative) | 0.072 | 100 |
| A2 (comparative) | 0.14 | 95 |
| A3 (comparative) | 0.13 | 104 |

Coatings B1–B6 were prepared to demonstrate chemical sensitization with sodium aurous(I) dithiosulfate. W1 and NW1 were added to Emulsion E1 to provide the sodium aurous(I) dithiosulfate levels (in mg per silver mole) indicated in Table III. Coating B1 contained unheated Emulsion E1. Sensitization with NW1 resulted in photothermographic coating B6 with lower speed than coating B1. Desired speed increases were obtained using chemical sensitizer source W1 prepared by procedure A.

TABLE III

| Coating | W1 | NW1 | DMIN | Speed |
|---|---|---|---|---|
| B1 (comparative) | 0 | 0 | 0.072 | 100 |
| B2 | 30 | 0 | 0.069 | 120 |
| B3 | 60 | 0 | 0.136 | 160 |
| B4 | 90 | 0 | 0.137 | 182 |
| B5 | 150 | 0 | 0.288 | 225 |
| B6 (comparative) | 0 | 60 | 0.073 | 80 |

Coatings C1–C3 were prepared to demonstrate chemical sensitization with Au(III) source potassium tetrachloroaurate. W3 and NW3 were added to Emulsion E1 to provide the sensitizer levels (in mg per silver mole) indicated in Table IV. Coating C1 contained unheated Emulsion E1. Sensitization with NW3 resulted in photothermographic coating C3 with lower speed than coating C1. A desired speed increase was obtained using chemical sensitizer source W3 which was prepared by procedure A.

TABLE IV

| Coating | W3 | NW3 | DMIN | Speed |
|---|---|---|---|---|
| C1 (comparative) | 0 | 0 | 0.072 | 100 |
| C2 | 40 | 0 | 0.088 | 125 |
| C3 (comparative) | 0 | 40 | 0.074 | 68 |

Coatings D1–D7 were prepared to demonstrate chemical sensitization with Au(I) source TTTAuT. Comparison coatings D5–D7 were treated with an acetone solution of TTTAuT, but had similar speed as coating D1 where no chemical sensitization treatment was employed. Use of TTTAuT source W4 prepared by procedure A provided superior results.

TABLE V

| Coating | W4 | NW4 | DMIN | Speed |
|---|---|---|---|---|
| D1 (comparative) | 0 | 0 | 0.072 | 100 |
| D2 | 35 | 0 | 0.072 | 177 |
| D3 | 70 | 0 | 0.086 | 214 |
| D4 | 105 | 0 | 0.123 | 194 |
| D5 (comp.) | 0 | 43 | 0.107 | 92 |
| D6 (comp.) | 0 | 86 | 0.12 | 96 |
| D7 (comp.) | 0 | 172 | 0.14 | 101 |

Coatings F1–F5 were prepared to demonstrate chemical sensitization with Au(I) source BTMTT. W5 and NW5 were added to Emulsion E1 to provide the sensitizer levels (in mg per silver mole) indicated in Table VI. Coating F1 contained unheated Emulsion E1 (i.e., a sample of the emulsion which was not chemically sensitized). Sensitization with NW5 resulted in photothermographic coating F5 with similar speed and fog as coating F1. Desired speed increases were obtained using the BTMTT source which was prepared by procedure A.

TABLE VI

| Coating | W5 | NW5 | DMIN | Speed |
|---|---|---|---|---|
| FI (comparative) | 0 | 0 | 0.072 | 100 |
| F2 | 35 | 0 | 0.082 | 120 |
| F3 | 70 | 0 | 0.090 | 184 |

TABLE VI-continued

| Coating | W5 | NW5 | DMIN | Speed |
|---|---|---|---|---|
| F4 | 105 | 0 | 0.109 | 202 |
| F5 (comparative) | 0 | 70 | 0.072 | 102 |

Coatings G1–G5 were prepared to demonstrate sulfur plus gold sensitization using chemical sensitizers sodium thiosulfate and potassium tetrachloroaurate. A combination of W2 and W3 or NW2 and NW3 were added to emulsion 1 to provide the sensitizer levels (in mg per silver mole) indicated in table VI. Although the emulsion in coating G5 was sensitized with equal levels of sodium thiosulfate and potassium tetrachloroaurate as the emulsion in coating G3, superior results were obtained using sensitizers prepared by procedure A.

TABLE VI

| Coating | W2 | W3 | NW2 | NW3 | DMIN | Speed |
|---|---|---|---|---|---|---|
| G1 (comparative) | 0 | 0 | 0 | 0 | 0.072 | 100 |
| G2 | 23 | 19 | 0 | 0 | 0.148 | 185 |
| G3 | 46 | 38 | 0 | 0 | 0.125 | 172 |
| G4 | 69 | 57 | 0 | 0 | 0.239 | 175 |
| G5 (comparative) | 0 | 0 | 46 | 38 | 0.086 | 115 |

The following set of examples illustrates that speed increases from chemical sensitization with procedure A materials may be obtained in the presence of a spectral sensitizing dye. Emulsions were chemically sensitized with sodium aurous(I) dithiosulfate and with a combination of sodium aurous(I) dithiosulfate and sodium thiosulfate. W1 and W2 were added to small portions of emulsion 1 and the mixture was heated for 15 minutes at 65° C. Photothermographic layers were prepared which contained 0.077 mg/dm$^2$ of spectral sensitizing Dye-1,2-(5,5-dicyano-4-phenyl-2,4-pentdienylidene)-1-ethyl-β-naphthothizoline, in addition to the ingredients previously mentioned. One set of coatings was exposed through a 0–4 neutral density step tablet and a Wrattan™ WR36+38A filter pack (to provide blue exposure, transmission 330 to 460 nm) for ⅕" with a 3000° K light source at 5.09 log lux. Another set of coatings was exposed through a 0–4 neutral density step tablet and a Wrattan WR9 filter (minus blue exposure, transmission >460 nm) for 1/50" with a 3000° K light source at 5.09 log lux to evaluate dyed speed. All coatings were thermally processed for six seconds at 120° C. Desired blue speed and dyed speed increases were observed with chemical sensitization.

TABLE VII

Sensitometric Results

| Coating | W1 | W2 | DMIN | Blue Speed | Dyed Speed |
|---|---|---|---|---|---|
| H1 (comparative) | 0 | 0 | 0.132 | 100 | 345 |
| H2 | 20 | 0 | 0.147 | 125 | 368 |
| H3 | 30 | 0 | 0.152 | 148 | 400 |
| H4 | 50 | 0 | 0.216 | 185 | 445 |
| H5 | 75 | 0 | 0.248 | 210 | 465 |
| H6 | 150 | 0 | 0.288 | 225 | 470 |
| H7 | 37.5 | 15 | 0.264 | 140 | 390 |
| H8 | 104 | 41 | 0.13 | 198 | 450 |

The invention has been described in detail with particular reference to preferred embodiments thereof, but it will be understood that variations and modifications can be effected within the spirit and scope of the invention.

What is claimed is:

1. A process of preparing a photothermographic composition of enhanced photosensitivity comprised of (a) precipitating light-sensitive silver halide grains in the presence of a non-aqueous polymeric peptizer and (b) then combining the silver halide grains with a non-aqueous polymeric vehicle containing an oxidation-reduction image-forming combination comprised of an organic silver compound and a reducing agent for the organic silver compound, wherein light-sensitivity of the silver halide grains is enhanced by, prior to step (b), sensitizing the silver halide grains with a gold sensitizer dissolved in an aqueous medium, the gold compound being chosen from the group consisting of gold tetrachloroaurate salts;

gold dithiosulfate salts;

gold sulfide;

gold thiolates;

gold compounds of the formula $\{AuL_2\}^+X^-$ or $\{AuLL'\}^+X^-$ wherein L is a mesoionic cyclic or acyclic thiourea ligand, L' is a Lewis base donor ligand, and X is an anion;

gold compounds of the formula:

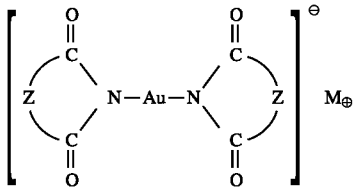

wherein M is a charge balancing cation and Z is chosen to complete a 5 or 6 membered ring forming an imide nucleus;

gold compounds containing at least one gold atom linking at least two divalent sulfur or selenium chalcogen atoms in a cyclic thioether or selenoether containing from 12 to 30 ring atoms; and a gold compound having the formula:

$$\{AuS_2X\}_n$$

wherein X is a dithiophosphinate, a dithiophosphate, a xanthate, a dithiocarbamate, or a dithiocarboxylate, and n is an integer of from 1 to 6.

2. A process according to claim 1 wherein at least one of the non-aqueous polymeric peptizer and non-aqueous polymeric vehicle are comprised of a vinyl acetal polymer.

3. A process according to claim 2 wherein the vinyl acetal polymer is a vinyl butyral polymer.

4. A process according to claim 1 wherein the gold sensitizer contains gold in a +1 oxidation state.

5. A process according to claim 4 wherein the gold sensitizer is chosen from the group consisting of

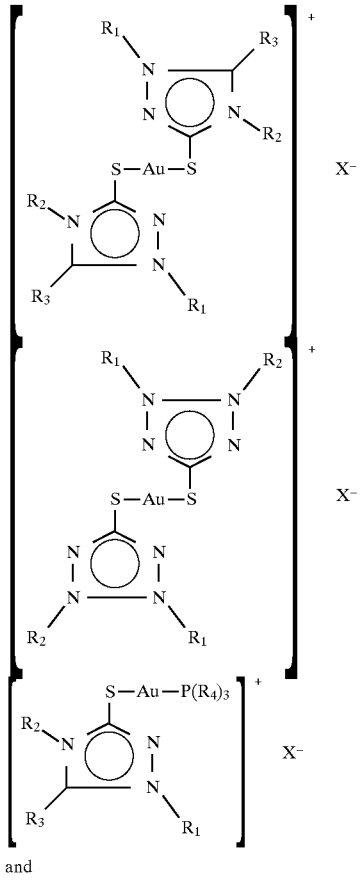

and

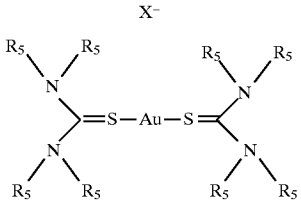

wherein $R_1$ and $R_4$ are independently chosen lower alkyl;

$R_2$, $R_3$ and $R_5$ are independently chosen from among lower alkyl, alkoxyalkyl, allyl, aryl, and cycloalkyl; and $X^-$ is a charge balancing anion.

6. A process according to claim 1 wherein sulfur sensitization is undertaken concurrently with step (b).

7. A process according to claim 1 wherein stirring and heating occurs during the step of chemical sensitization.

8. A process of preparing a photothermographic composition of enhanced photosensitivity comprised of (a) precipitating light-sensitive silver halide grains in the presence of a volatile organic solvent and a vinyl butyral polymer containing, on a mole basis, repeating units that are from 80 to 88 percent provided by vinyl butyral monomer, from 10 to 20 percent provided by vinyl acetate monomer, and from 0 to 2.5 percent provided by vinyl alcohol monomer;

(b) chemically sensitizing the grains by stirring and heating following the addition of a gold sensitizer dispersed in an aqueous medium, the gold sensitizer being chosen from the group consisting of

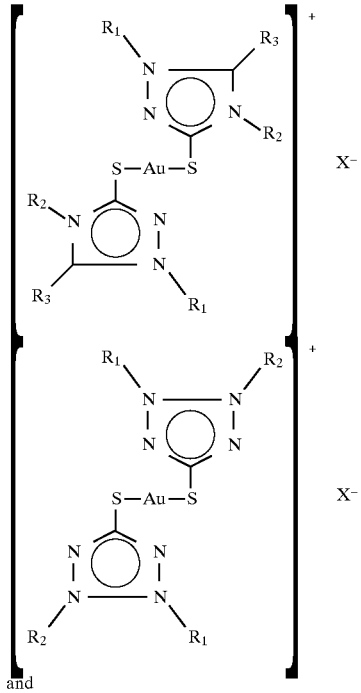

and

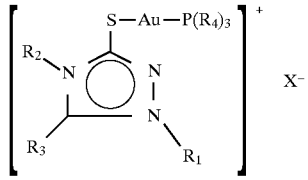

wherein $R_1$ and $R_4$ are methyl;

$R_2$ and $R_3$ are independently chosen from among methyl, methoxymethyl, allyl, phenyl, and cyclohexyl; and $X^-$ is a charge balancing anion, and (c) combining the chemically sensitized silver halide grains dispersed in the vinyl butyral polymer with an oxidation-reduction combination comprised of a silver carboxylate and a reducing agent for the silver carboxylate.

* * * * *